US010526827B2

(12) United States Patent
Salice

(10) Patent No.: US 10,526,827 B2
(45) Date of Patent: Jan. 7, 2020

(54) HINGE FOR FURNITURE LEAVES THAT OPEN DOWNWARDLY

(71) Applicant: ARTURO SALICE S.P.A., Novedrate (IT)

(72) Inventor: Luciano Salice, Carimate (IT)

(73) Assignee: ARTURO SALICE S.P.A., Novedrate (IT)

( * ) Notice: Subject to any disclaimer, the term of this patent is extended or adjusted under 35 U.S.C. 154(b) by 0 days.

(21) Appl. No.: 15/569,562

(22) PCT Filed: Apr. 27, 2016

(86) PCT No.: PCT/EP2016/059354

§ 371 (c)(1),
(2) Date: Oct. 26, 2017

(87) PCT Pub. No.: WO2016/174061

PCT Pub. Date: Nov. 3, 2016

(65) Prior Publication Data

US 2018/0252010 A1 Sep. 6, 2018

(30) Foreign Application Priority Data

Apr. 30, 2015 (IT) ..... MI2015A0620

(51) Int. Cl.
*E05F 1/08* (2006.01)
*E05D 3/14* (2006.01)
(Continued)

(52) U.S. Cl.
CPC ..... *E05D 3/14* (2013.01); *E05D 5/0276* (2013.01); *E05F 3/20* (2013.01); *E05F 5/006* (2013.01); *E05Y 2900/20* (2013.01)

(58) Field of Classification Search
CPC . Y10T 16/554; Y10T 16/551; Y10T 16/5385; Y10T 16/5383; Y10T 16/547;
(Continued)

(56) References Cited

U.S. PATENT DOCUMENTS 3,673,635 A 7/1972 Schadow
4,411,046 A * 10/1983 Nawrath ..... E05D 3/183 16/354
(Continued)

FOREIGN PATENT DOCUMENTS

CN 104295177 A 1/2015
DE 202004021727 U1 7/2010
(Continued)

OTHER PUBLICATIONS

International Search Report and Written Opinion dated Jun. 24, 2016 issued in PCT/EP2016/059354.
(Continued)

*Primary Examiner* — Chuck Y Mah
(74) *Attorney, Agent, or Firm* — Scully, Scott, Murphy & Presser, P.C.

(57) ABSTRACT

A hinge for leaves of furniture that open downwardly, which comprises a fixed part which can be connected to a back wall or a horizontal wall of the piece of furniture, and a moveable part which can be connected to a leaf of the piece of furniture, the fixed part and the moveable part being mutually connected so as to allow oscillation by way of articulation means which comprise at least one oscillation axis so that they can move between a closed position and an open position, in which the leaf lies substantially on the same plane of arrangement as the back wall or horizontal wall of the piece of furniture, and articulated supporting levers.

11 Claims, 6 Drawing Sheets

(51) Int. Cl.
*E05F 5/00* (2017.01)
*E05D 5/02* (2006.01)
*E05F 3/20* (2006.01)

(58) Field of Classification Search
CPC ..... Y10T 16/53864; E05D 7/04; E05D 7/06; E05D 7/0407; E05D 7/0415; E05D 3/186; E05D 3/06; E05D 3/122; E05D 3/14; E05D 3/16; E05D 2003/163; E05D 11/06; E05D 5/0276; E05Y 2201/618; E05Y 2201/62; E05Y 2201/71; E05Y 2201/716; E05Y 2201/712; E05Y 2900/20; E05F 3/20; E05F 5/006
See application file for complete search history.

(56) References Cited

U.S. PATENT DOCUMENTS 5,035,026 A * 7/1991 Carlo ..... E05D 3/16 16/288
5,450,655 A * 9/1995 Ferrari ..... E05D 3/16 16/368
6,308,376 B1 * 10/2001 Koshikawa ..... E05D 3/16 16/250
6,684,453 B2 * 2/2004 Wang ..... E05F 5/006 16/54
7,530,142 B2 * 5/2009 Sutterlutti ..... E05D 11/1014 16/242
7,533,445 B2 * 5/2009 Salice ..... E05D 3/142 16/286
7,591,046 B2 * 9/2009 Zetti ..... E05D 3/16 16/286
7,861,376 B2 * 1/2011 Fitz ..... E05D 3/16 16/286
8,205,298 B2 * 6/2012 Lin ..... E05F 5/006 16/245
8,572,811 B2 * 11/2013 Lautenschlager ..... E05D 3/14 16/286
8,713,760 B2 * 5/2014 Krudener ..... E05D 3/16 16/370
9,290,975 B2 * 3/2016 Dubach ..... E05D 3/06
9,777,525 B2 * 10/2017 Salice ..... E05D 3/16
2001/0025398 A1 * 10/2001 Zetti ..... E05D 3/16 16/370
2012/0186042 A1 * 7/2012 Salice ..... E05D 11/1021 16/297
2013/0180081 A1 * 7/2013 Salice ..... E05F 1/10 16/64
2015/0330128 A1 * 11/2015 Ng ..... E05D 3/16 16/65
2017/0218671 A1 * 8/2017 Frank ..... E05D 7/0423
2017/0241176 A1 * 8/2017 Zetti ..... E05D 3/16
2018/0087307 A1 * 3/2018 Hammerer ..... E05D 3/06

FOREIGN PATENT DOCUMENTS

EP 2 218 861 A2 8/2010
WO 2014/153713 A1 10/2014
WO 2015014814 A1 2/2015

OTHER PUBLICATIONS

Italian Search Report dated Jan. 11, 2016 issued in IT MI20150620, with partial translation.
English-language translation of Taiwanese Examination Report dated Oct. 1, 2019 received in Taiwanese Application No. 105113244.

* cited by examiner

HINGE FOR FURNITURE LEAVES THAT OPEN DOWNWARDLY

CROSS-REFERENCE TO RELATED APPLICATIONS

This Application is a 371 of International Application PCT/EP2016/059354, filed on Apr. 27, 2016, which claims priority to Application MI2015A000620 filed on Apr. 20, 2015.

BACKGROUND OF THE DISCLOSURE

The present invention relates to a hinge for furniture leaves that open downwardly. More specifically, the invention relates to a hinge for leaves that open downwardly about at least one horizontal axis.

As is known, in the furniture sector there are many items of furniture that have leaves that open downwardly by way of an oscillating motion about at least one horizontal axis.

Such leaves are in particular connected to a back wall of a fixed body of the piece of furniture by way of hinges that are designed to enable the leaves to perform this oscillating motion.

The hinges that are most commonly used in such types of furniture comprise a fixed part, which can be anchored to the back wall of the piece of furniture, and a moveable part, which can be fixed to the leaf. The fixed part and the moveable part are mutually connected so as to oscillate by way of an articulation system that comprises two rockers and four articulation axes that form an articulated quadrilateral, and which is configured so that the open leaf lies substantially in the plane of the part of the piece of furniture with respect to which the leaf oscillates.

However, the hinges described above are not capable on their own of exerting sufficient support of the leaf in the fully open position, or of controlling the speed of movement of the opening of the leaf.

To support the open leaf, and also to control the opening movement of the leaf, support systems are usually provided which, such as for example disclosed in WO 2015/014814, are in the form of devices that are separate from and independent of the hinges and which comprise a body that can be connected to a lateral wall of the piece of furniture in a position that is spaced apart upwardly from the hinges, means of combined rotation and translation for winding a support cable being connectable to the leaf, and deceleration and/or elastic means which are functionally connected to the winding means in order to control the winding/unwinding of the cable and hence the speed of the opening movement of the leaf and in order to support such leaf in its final open position.

As an alternative to such devices the use is known of telescopic supporting rods that extend from a lateral wall of the piece of furniture and the leaf, which are provided with elastic means and/or deceleration means so as to define the extent and/or oscillation of the rods and so control in this case also the opening movement of the leaf and support the leaf in its final open position.

However, the above mentioned support devices clutter up the lateral walls of the piece of furniture and they involve additional mounting operations to fix the parts of the devices to the lateral walls and to the leaves of the piece of furniture.

BRIEF SUMMARY OF THE DISCLOSURE

Furthermore, any errors in the positioning of the support devices with respect to the parts of the piece of furniture and/or with respect to the hinges can lead to problems with operation and reliability.

The aim of the present invention is to devise a hinge for furniture leaves that open downwardly about at least one horizontal axis, which makes it possible to support the leaf in the fully open position, and to reliably control the speed of movement of its opening, while preventing the danger of detachment, impacts or uncontrolled opening movements of the leaves.

Within this aim, an object of the present invention is to devise a hinge for furniture leaves that open downwardly which has particularly reduced encumbrances and which at the same time enables a considerable simplification of the overall mounting of such leaves.

Another object of the present invention is to devise a hinge for furniture leaves that open downwardly which is highly reliable, easily and practically implemented and low cost.

This aim and these and other objects which will become better apparent hereinafter are achieved by a hinge for leaves of pieces of furniture that open downwardly, which comprises a fixed part which can be connected to a back wall or a horizontal wall of the piece of furniture, and a moveable part which can be connected to a leaf of the piece of furniture, said fixed part and said moveable part being mutually connected so as to allow oscillation by way of articulation means which comprise at least one oscillation axis so that they can move between a closed position and an open position, in which said leaf lies substantially on the same plane of arrangement as said back wall or horizontal wall of the piece of furniture, characterized in that it comprises articulated supporting levers which are adapted to connect the fixed part of the hinge with a portion of the moveable part of the hinge or with the leaf, at least one of said supporting levers being connected to the fixed part of the hinge and being shaped so that in the open position of the leaf it comes into contact with a resting surface of said fixed part of the hinge or of said wall of the piece of furniture, and in that one end of said supporting lever is connected to said portion of said moveable part of the hinge or with the leaf by way of another one of said supporting levers.

BRIEF DESCRIPTION OF THE SEVERAL VIEWS OF THE DRAWINGS

Further characteristics and advantages of the invention will become better apparent from the description of a preferred, but not exclusive, embodiment of the hinge according to the present invention, which is illustrated by way of non-limiting example in the accompanying drawings wherein.

DETAILED DESCRIPTION OF THE DISCLOSURE

Figure 1:
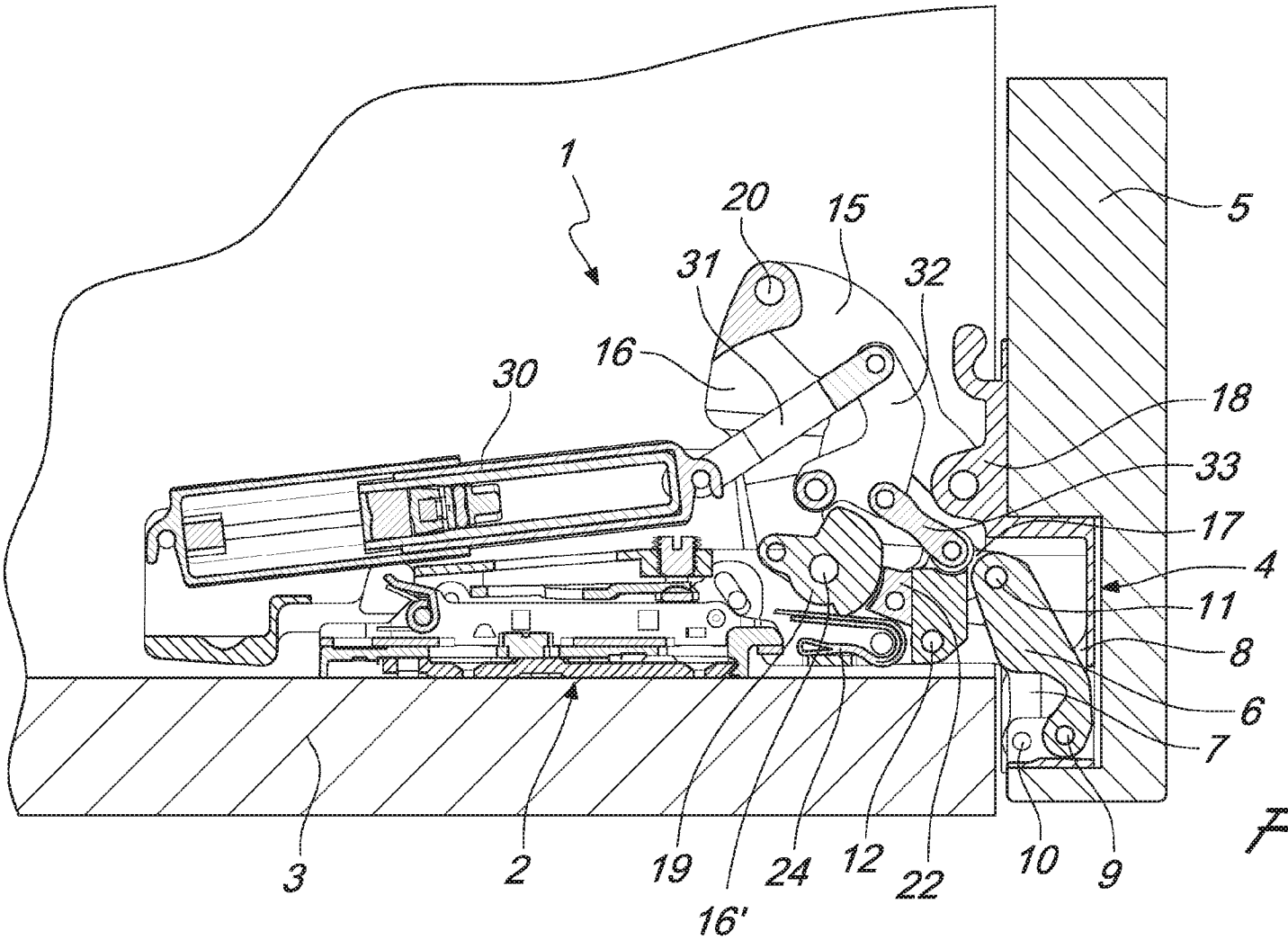
FIG. 1 is a longitudinal cross-sectional view of a hinge according to the invention with the leaf closed.
Figure 2:
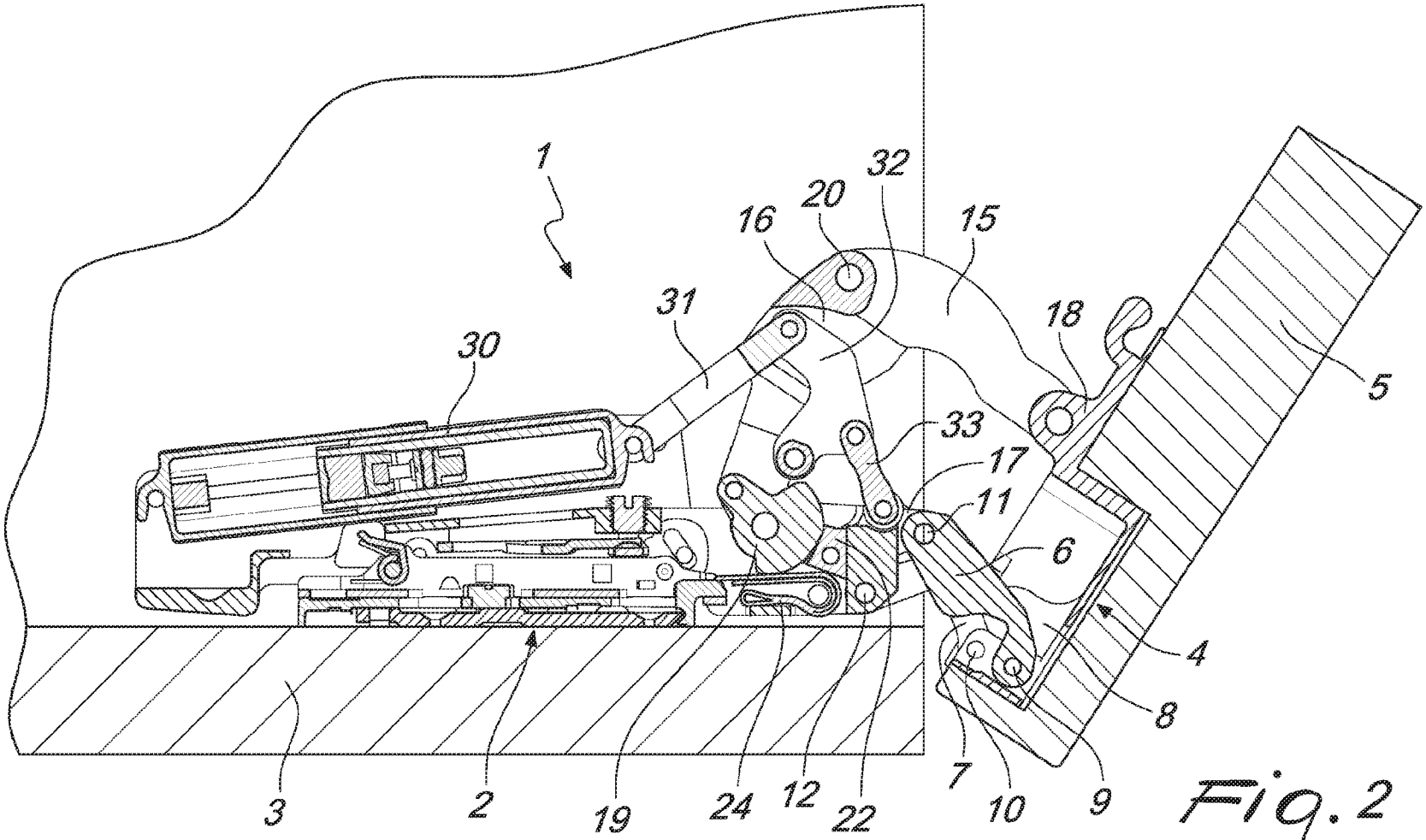
FIG. 2 is a longitudinal cross-sectional view of the hinge according to the invention with the leaf half-open.
Figure 3:
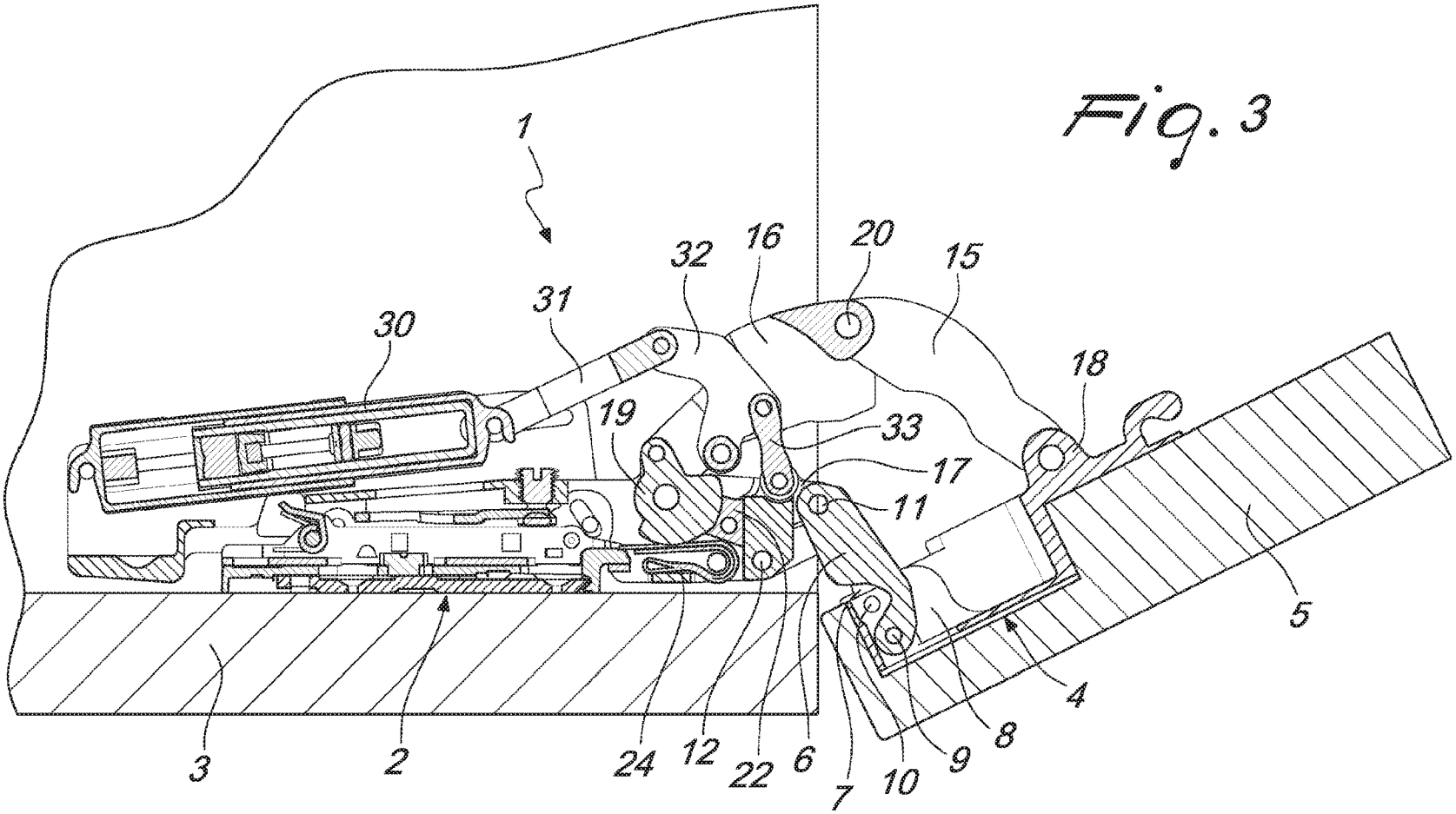
FIG. 3 is a longitudinal cross-sectional view of the hinge according to the invention with the leaf open further.
Figure 4:
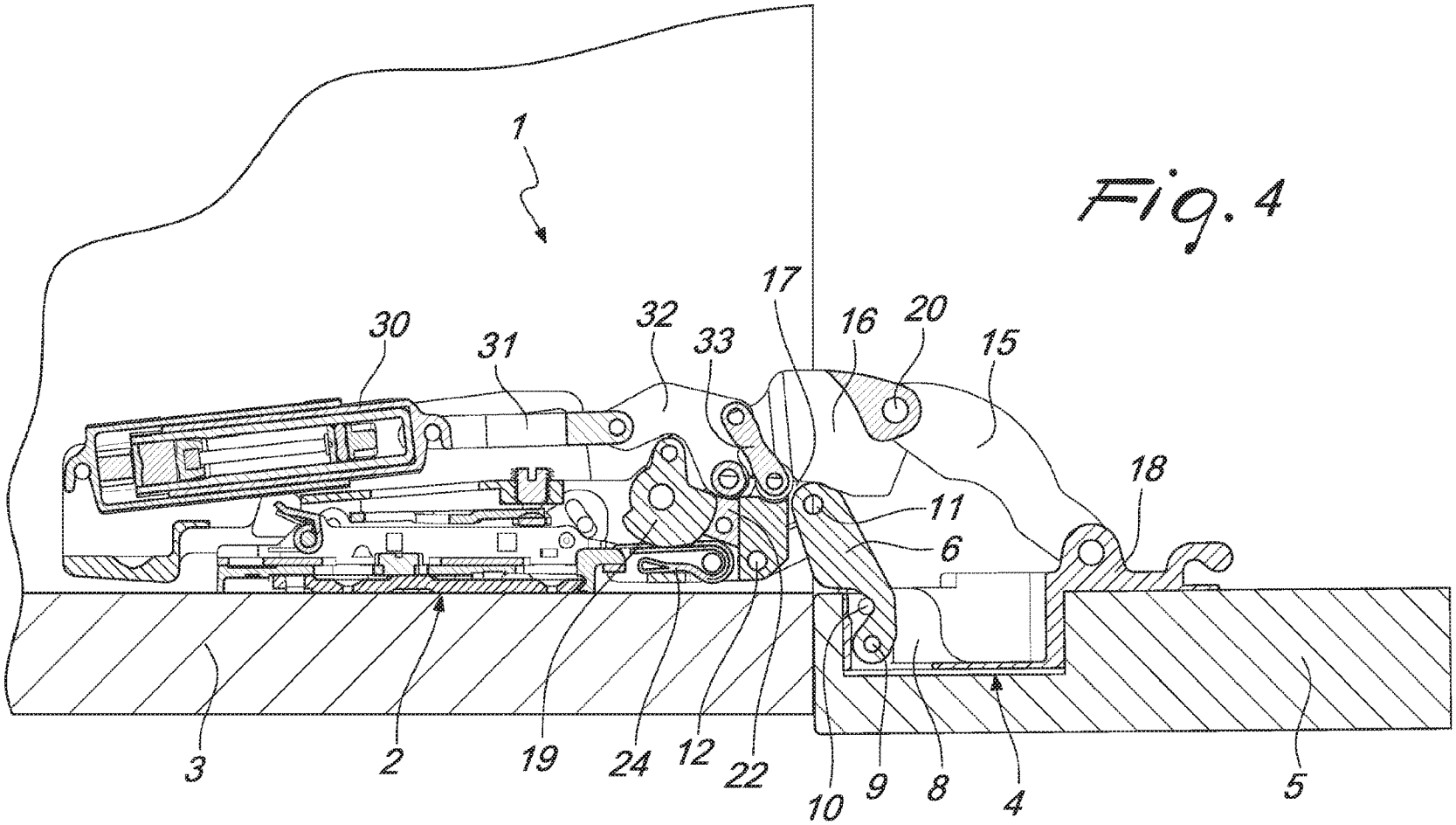
FIG. 4 is a longitudinal cross-sectional view of the hinge according to the invention with the leaf fully open.
Figure 5:
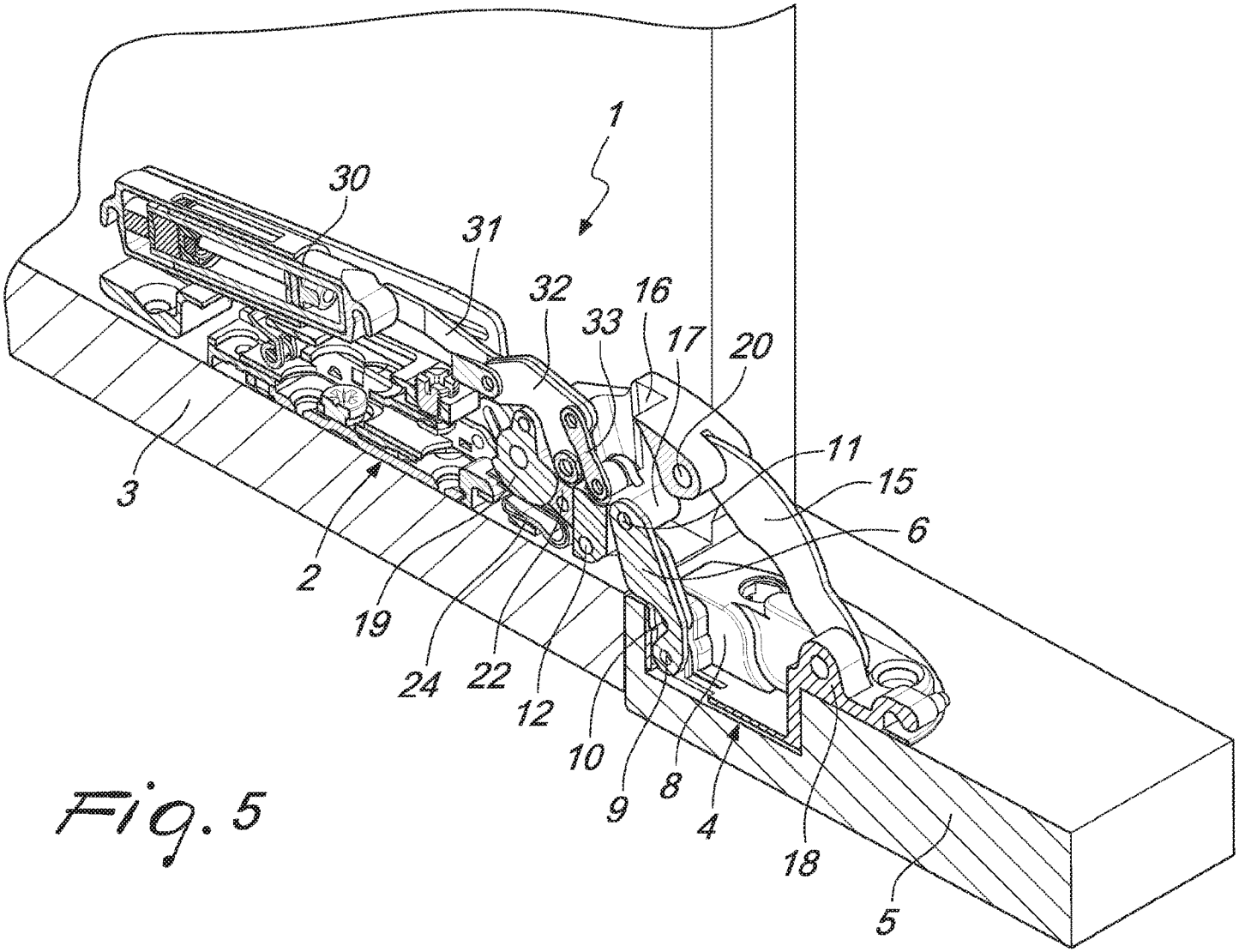
FIG. 5 is a perspective view of the longitudinal cross-section of the hinge according to the invention with the leaf fully open.
Figure 6:
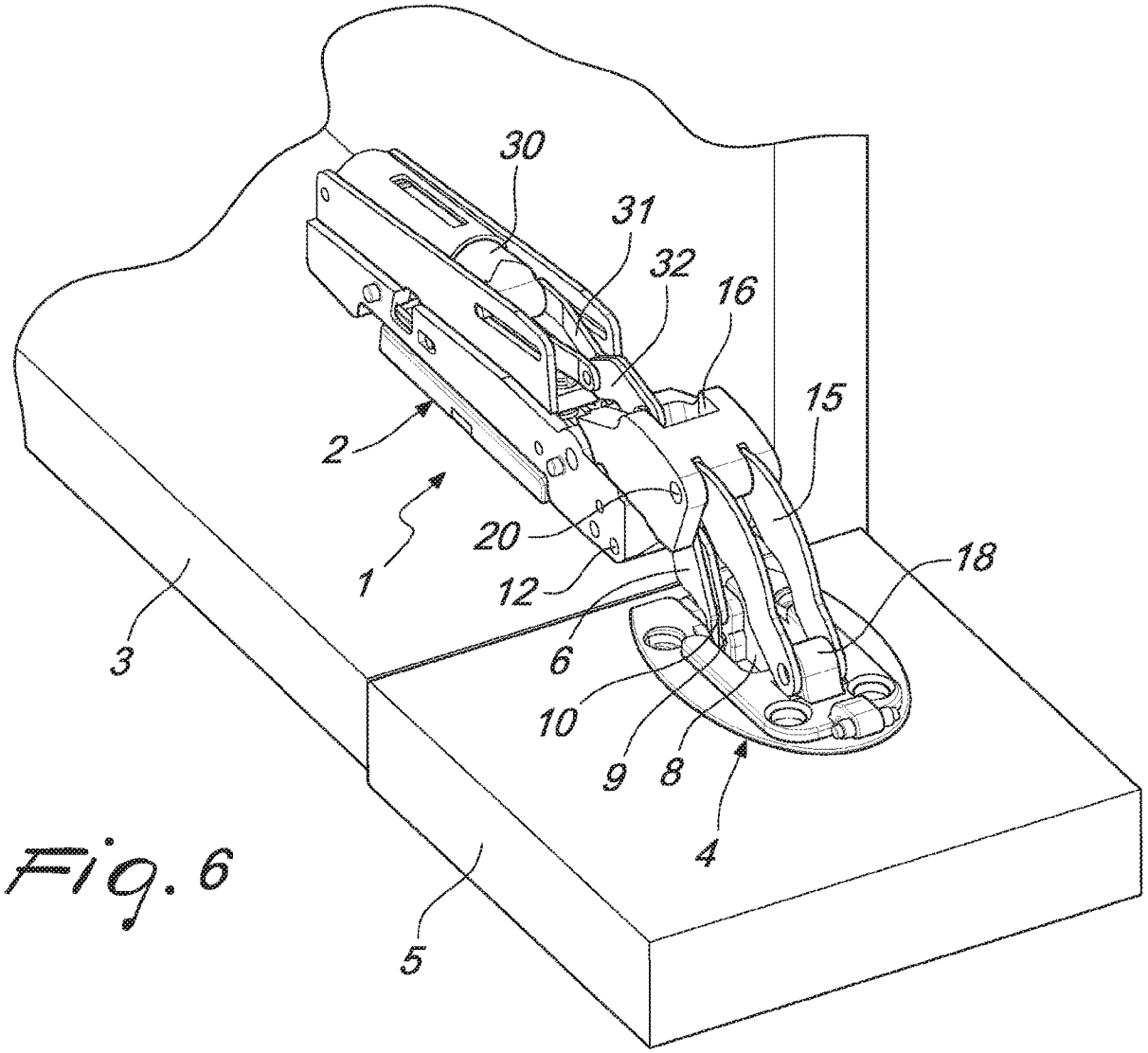
FIG. 6 is a perspective view of the hinge according to the invention with the leaf fully open.

With reference to the figures, the hinge according to the invention, generally designated by the reference numeral 1, comprises a fixed part 2 which can be connected to a back wall or a horizontal wall 3 of the piece of furniture, and a moveable part 4 which can be connected to a leaf 5 of the piece of furniture.

The fixed part 2 and the moveable part 4 of the hinge 1 are mutually connected so as to oscillate by way of articulation means which comprise at least one oscillation axis and preferably four oscillation axes and two rockers.

The articulation means make it possible to move the leaf 5 between a closed position and an open position in which the leaf lies substantially in the same plane in which the back wall or horizontal wall 3 of the piece of furniture lies.

In particular, the articulation means, as shown in the figures, comprise at least one rocker and preferably a first rocker 6 and a second rocker 7, which are connected respectively at a first end thereof to a box 8 of the moveable part 4 of the hinge, by way of a first pin 9 and a second pin 10, respectively, and with a second end thereof they are connected to the fixed part 2 of the hinge by way of respectively the third pin 11 and a fourth pin 12. In this manner, the two rockers 6 and 7 define an articulated quadrilateral.

A plurality of articulated supporting levers, and preferably a first and a second supporting lever, connect the fixed part of the hinge with an advanced portion (advanced with respect to the articulation means and to the front plane of the piece of furniture) of the moveable part of the hinge or with the leaf.

The figures show the case in which there are two supporting levers, respectively 15 and 16, in which the lever 16 is connected so as to oscillate to an advanced part 17 of the fixed part 2 and is contoured and arranged so that in the open position of the leaf 4 it preferably protrudes beyond the front plane of the piece of furniture and comes into contact directly or indirectly with a resting surface of the advanced part 17 of the fixed part. In particular, the lever 15 is pivoted at one of its ends with a protruding part 18 of the moveable part 4 of the hinge connected to the leaf 5, while the other end of the lever 15 is connected to a second lever 16 which in turn is connected so as to oscillate, together with a cam 19, to the advanced part 17 of the fixed part 2 of the hinge 1 at an axle 16'.

Alternatively, the lever 16 can come into contact directly or indirectly with a resting surface of the back wall or horizontal wall of the piece of furniture.

The second lever 16 is shaped so that, in the open condition of the leaf 5, it abuts against the advanced part 17 of the fixed part 2 of the hinge 1 and preferably it protrudes externally with respect to the piece of furniture.

The advanced part 17 of the fixed part 2 of the hinge 1 is substantially proximate to the pivoting point of the first rocker 6, i.e. at the third pin 11.

The pivoting between the first lever 15 and the second lever 16 occurs by way of a pin 20 while the second lever 16, at the opposite end to the pin 20, as mentioned is connected to the fixed part 2 of the hinge by way of the axle 16'.

The hinge according to the invention further comprises braking means and/or deceleration means.

The braking means are preferably constituted by a cam 19 and by a slider 22 against which the cam abuts when it rotates, with progressive braking during opening.

Substantially, the cam 19, which is integral with the second lever 16, rotates about the axle 16' and with its rotation, when the leaf 5 is opened, it comes up against the slider 22 which is arranged fixed at the fixed part 2 of the hinge 1, thus exerting a braking action.

Elastic means 24 are provided in order to keep the leaf 5 in the closed position, the elastic means 24 being actuated by the same cam 19 in the first braking means.

As we have seen, the cam 19 exerts a braking action which is variable (basically it grows substantially along an entire opening arc).

The hinge further comprises, as mentioned, means of deceleration, which are constituted by means for decelerating the opening movement, in particular of the end portion of the opening movement.

The deceleration means are constituted preferably by a fluid-operated linear decelerator 30, which is functionally connected (directly or by way of transmission means) to one of the supporting levers 15, 16 or to one of the articulation means 6, 7, or to the moveable element of the hinge.

Preferably, the decelerator 30 is fixed detachably to the fixed part 2 of the hinge, for example inserted in fixing elements that can be coupled to the fixed part 2 on one side and to actuation means thereof on the other side.

The figures show a configuration in which the actuation means of the decelerator comprise a plurality of levers 31, 32 and 33 which are connected to the fixed part 2 of the hinge and to the supporting lever 16.

Conveniently, the deceleration means can also be actuated by only one lever.

The braking means and the deceleration means can be provided individually or in mutual combination.

It is further possible to provide means for adjusting deceleration and/or braking, not shown in the figures; for example for the deceleration means can be provided for adjusting the travel of the decelerator, while for the braking means can be provided for adjusting the position of the slider 22 or the angular position of the cam 19.

It is likewise possible to provide means for adjusting the position of the fixed part of the hinge with respect to the back wall or horizontal wall of the piece of furniture in at least one of the vertical, frontal and/or lateral directions, for example by having the fixed part 2 be made up of several parts that can move with respect to each other, and controlling the movements between these by way of screw-operated or cam-based adjustment elements; by way of such means it is possible to adjust the position of the leaf so that in the fully open position it comes into contact with the front surface of the piece of furniture, thus achieving a better support of the leaf.

Therefore, the hinge according to the invention is capable of supporting the leaf in the open position and also of reliably controlling the speed of movement of the opening of the leaf.

The hinge further has reduced encumbrances and an evident simplicity of mounting.

In practice it has been found that the hinge according to the present invention fully achieves the set aim and objects.

The hinge, thus conceived, is susceptible of numerous modifications and variations, all of which are within the scope of the appended claims.

Moreover, all the details may be substituted by other, technically equivalent elements.

In practice, the materials used, as well as the contingent shapes and dimensions, may be any according to the requirements and the state of the art.

The disclosures in Italian Patent Application No. MI2015A000620 (102015902347518) from which this application claims priority are incorporated herein by reference.

The invention claimed is:

1. A hinge for leaves of furniture that open downwardly, which comprises:

a fixed part which can be connected to a wall of the piece of furniture; and a moveable part which can be connected to a leaf of the piece of furniture, said fixed part and said moveable part being mutually connected so as to allow oscillation by way of articulation means which comprise a plurality of oscillation axes so that they can move between a closed position and an open position, in which said leaf lies substantially on the same plane of arrangement as said wall of the piece of furniture;

a first articulated supporting lever and a second articulated supporting lever which are adapted to connect the fixed part of the hinge with a portion of the moveable part of the hinge and are adapted to rotate about at least one of the oscillation axes between the closed position and the open position, at least one of said first articulated supporting lever and said second articulated supporting lever being connected to the fixed part of the hinge and being shaped so that in the open position of the leaf it comes into contact with a resting surface of said fixed part of the hinge or of said wall of the piece of furniture;

a device for decelerating the opening movement of said leaf, said deceleration device configured to detach, being arranged on said fixed part, and being connected to one of the supporting levers, to one of the oscillation axes, or to the moveable part of the hinge, and wherein one end of one of said first articulated supporting lever and said second articulated supporting lever is connected to said portion of said moveable part of the hinge, wherein one of said first articulated supporting lever and said second articulated supporting lever, which is not connected to said moveable part of the hinge, is connected with the leaf.

2. The hinge according to claim 1, wherein at least one of said first articulated supporting lever and said second articulated supporting lever is connected to the fixed part is shaped so that in the open position of the leaf it protrudes beyond said wall of the piece of furniture.

3. The hinge according to claim 1, further comprising four oscillation axes and two rockers, wherein said rockers comprise a first rocker and a second rocker in order to connect said moveable part of the hinge to said fixed part.

4. The hinge according to claim 1, wherein said deceleration device comprises a linear decelerator which is connected to one of the first articulated supporting lever and said second articulated supporting lever or to one of the oscillation axes or to the moveable part of the hinge.

5. The hinge according to claim 1, further comprising a device for braking the opening movement, said braking device comprising a moveable cam which is integral with one of said first articulated supporting lever and said second articulated supporting lever and is shaped so as to interact with at least one friction element which is integral with the fixed part of the hinge.

6. The hinge according to claim 5, further comprising means for adjusting the braking of the braking device.

7. The hinge according to claim 5, further comprising elastic means for retaining the closure portion of the leaf of the piece of furniture, said elastic means being actuated by said moveable cam of the braking means.

8. The hinge according to claim 1, further comprising means for adjusting deceleration of said deceleration device.

9. The hinge according to claim 1, further comprising actuation means for said deceleration device, said actuation means comprising a first lever, a second lever and a third lever, a first lever connected to the fixed part, a third lever connected to one of said first articulated supporting lever and said second articulated supporting lever, and a second lever connected to both the first lever and the third lever.

10. The hinge according to claim 1, further comprising means for adjusting the position of said fixed part of the hinge with respect to said wall of the piece of furniture in at least one of the vertical, frontal and/or lateral directions.

11. A hinge for leaves of furniture that open downwardly, which comprises:

a fixed part which can be connected to a wall of the piece of furniture; and a moveable part which can be connected to a leaf of the piece of furniture, said fixed part and said moveable part being mutually connected so as to allow oscillation by way of articulation means which comprise a plurality of oscillation axes so that they can move between a closed position and an open position, in which said leaf lies substantially on the same plane of arrangement as said wall of the piece of furniture;

a first articulated supporting lever and a second articulated supporting lever which are adapted to connect the fixed part of the hinge with a portion of the moveable part of the hinge and are adapted to rotate about at least one of the oscillation axes between the closed position and the open position, at least one of said first articulated supporting lever and said second articulated supporting lever being connected to the fixed part of the hinge and being shaped so that in the open position of the leaf it comes into contact with a resting surface of said fixed part of the hinge or of said wall of the piece of furniture; and actuation means for a deceleration device, said deceleration device configured to decelerate the opening movement of said leaf, said actuation means comprising a first lever, a second lever and a third lever, a first lever connected to the fixed part, a third lever connected to one of said first articulated supporting lever and said second articulated supporting lever, and a second lever connected to both the first lever and the third lever, wherein one end of one of said first articulated supporting lever and said second articulated supporting lever is connected to said portion of said moveable part of the hinge, wherein one of said first articulated supporting lever and said second articulated supporting lever, which is not connected to said moveable part of the hinge, is connected with the leaf.

* * * * *